US010003164B1

(12) United States Patent
Ho

(10) Patent No.: US 10,003,164 B1
(45) Date of Patent: Jun. 19, 2018

(54) POWER STRIP ASSEMBLY

(71) Applicant: Oxti Corporation, Taipei (TW)

(72) Inventor: Chih Feng Ho, Taipei (TW)

(73) Assignee: Oxti Corporation, Chungho, Taipei (TW)

( * ) Notice: Subject to any disclaimer, the term of this patent is extended or adjusted under 35 U.S.C. 154(b) by 0 days. days.

(21) Appl. No.: 15/679,344

(22) Filed: Aug. 17, 2017

(51) Int. Cl.
*H01R 13/60* (2006.01)
*H01R 25/00* (2006.01)

(52) U.S. Cl.
CPC ..... *H01R 25/006* (2013.01)

(58) Field of Classification Search
CPC ..... H01R 25/006; H01R 25/003
USPC ..... 439/540.1
See application file for complete search history.

(56) References Cited

U.S. PATENT DOCUMENTS 4,379,605 A * 4/1983 Hoffman ..... H01R 25/006 439/107
5,071,367 A 12/1991 Lun
5,595,494 A 1/1997 Wiebe
6,086,397 A 7/2000 Chapman et al.
6,164,996 A 12/2000 Yu
6,220,880 B1 * 4/2001 Lee ..... H01R 25/003 439/214
6,410,994 B1 6/2002 Jones et al.
6,454,609 B1 9/2002 Huang
6,739,905 B2 5/2004 Yokota
6,816,359 B1 * 11/2004 Hsiao ..... H01R 25/003 174/135
7,154,402 B2 12/2006 Dayoub

* cited by examiner

*Primary Examiner* — Jean F Duverne
(74) *Attorney, Agent, or Firm* — Charles E. Baxley

(57) ABSTRACT

A power strip assembly includes a carrier member extended from a carrier panel for supporting a receptacle and a number of plug connecting members, a clamping device includes a coupling extension extended from a follower, and one or more anchoring elements disposed below the follower and each pivotally attached to the coupling extension with a pivot axle for engaging with the table plate, the anchoring element is pivotable relative to the coupling extension between a working position parallel to the coupling extension and a folded position perpendicular to the coupling extension, and a fastener is engaged with the carrier member and the follower for moving the follower relative to the table plate and to be secured to the table plate with the fastener.

8 Claims, 4 Drawing Sheets

POWER STRIP ASSEMBLY

BACKGROUND OF THE INVENTION

1. Field of the Invention

The present invention relates to a power strip assembly or carrier or support device, and more particularly to a power strip assembly including an improved structure arranged for allowing the power strip assembly to be easily actuated to a table or support member by the user.

2. Description of the Prior Art

Typical power strips comprise a housing body or the like for receiving one or more sockets or plug connecting members and for engaging with plugs or the like and thus for connecting to various electrical or computer facilities or the like.

For example, U.S. Pat. No. 5,071,367 to Lun, U.S. Pat. No. 5,595,494 to Wiebe, U.S. Pat. No. 6,086,397 to Chapman et al., U.S. Pat. No. 6,164,996 to Yu, U.S. Pat. No. 6,410,994 to Jones et al, U.S. Pat. No. 6,454,609 to Huang, U.S. Pat. No. 6,739,905 to Yokota, and U.S. Pat. No. 7,154,402 to Dayoub disclose several of the typical power strips or the like each also comprising a housing body for receiving one or more sockets or plug connecting members.

However, the housing body for receiving the sockets or plug connecting members may not be easily and quickly attached or mounted or secured or clamped onto various supporting members or tables.

The present invention has arisen to mitigate and/or obviate the afore-described disadvantages of the conventional power strip assemblies or carriers or support devices.

SUMMARY OF THE INVENTION

The primary objective of the present invention is to provide a power strip assembly including an improved structure arranged for allowing the power strip assembly or carrier or support device to be easily actuated to a table or support member by the user.

The other objective of the present invention is to provide a power strip assembly including an anchoring board attachable to a carrier member for allowing the carrier member to be easily and quickly and readily engaged through a tiny space beside an edge portion of a table plate.

In accordance with one aspect of the invention, there is provided a power strip assembly for attaching to a table plate, comprising a carrier device including a carrier panel, and including a carrier member extended from the carrier panel, a receptacle supported on the carrier panel, a number of plug connecting members engaged in the receptacle, a clamping device including a follower to be supported on the table plate, a coupling extension extended from the follower, and an anchoring element provided below the follower and pivotally attached to the coupling extension of the follower with a pivot axle for engaging with the table plate, the follower including a screw hole formed therein, the anchoring element being pivotable relative to the coupling extension between a first position where the anchoring element is parallel to the coupling extension, and a second position where the anchoring element is perpendicular to the coupling extension, and a fastener engaged through the carrier member and engaged with the screw hole of the follower for moving the follower up and down relative to the table plate when the fastener is rotated relative to the follower, for allowing the follower to be secured to the table plate with the fastener.

The anchoring element includes a tilted lower surface inclined relative to the coupling extension and the pivot axle. The anchoring element includes a flat upper surface perpendicular to the coupling extension and parallel to the follower and the table plate for stably contacting and engaging with the table plate and for allowing the table plate to be solidly and stably anchored and positioned between the follower and the anchoring element.

The carrier member includes a compartment formed in the carrier member, the carrier member includes a through hole formed in the carrier member and communicating with the compartment of the carrier member and aligned with the screw hole of the follower for engaging with the fastener and for allowing the fastener to be engaged with the screw hole of the follower.

The compartment of the carrier member includes a non-circular cross section and opened downwardly, and the follower includes a non-circular cross section for being guided and limited to slide up and down relative to the compartment of the carrier member and for preventing the follower from being rotated relative to the carrier member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
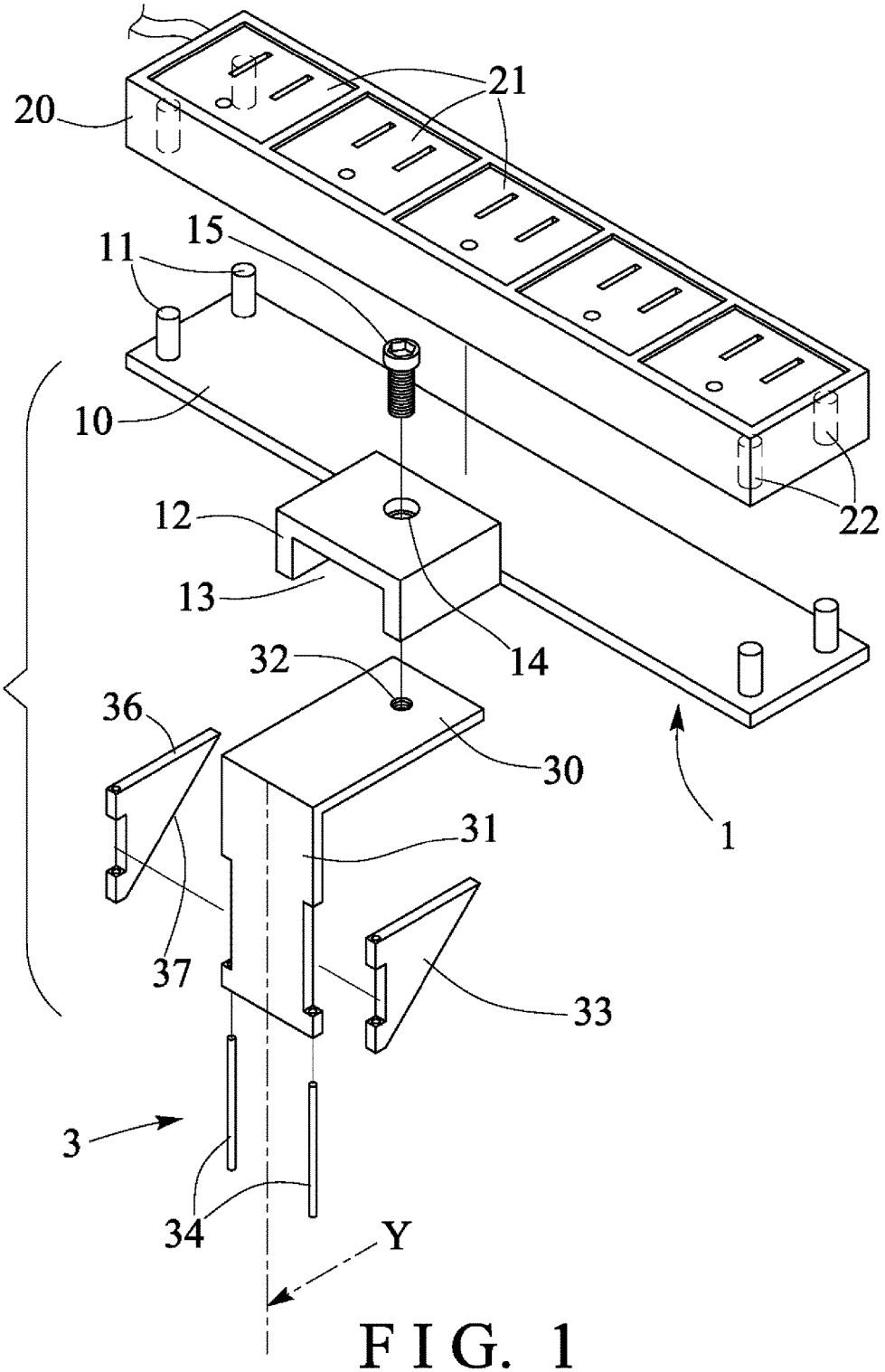
FIG. 1 is a partial exploded view of a power strip assembly in accordance with the present invention.
Figure 2:
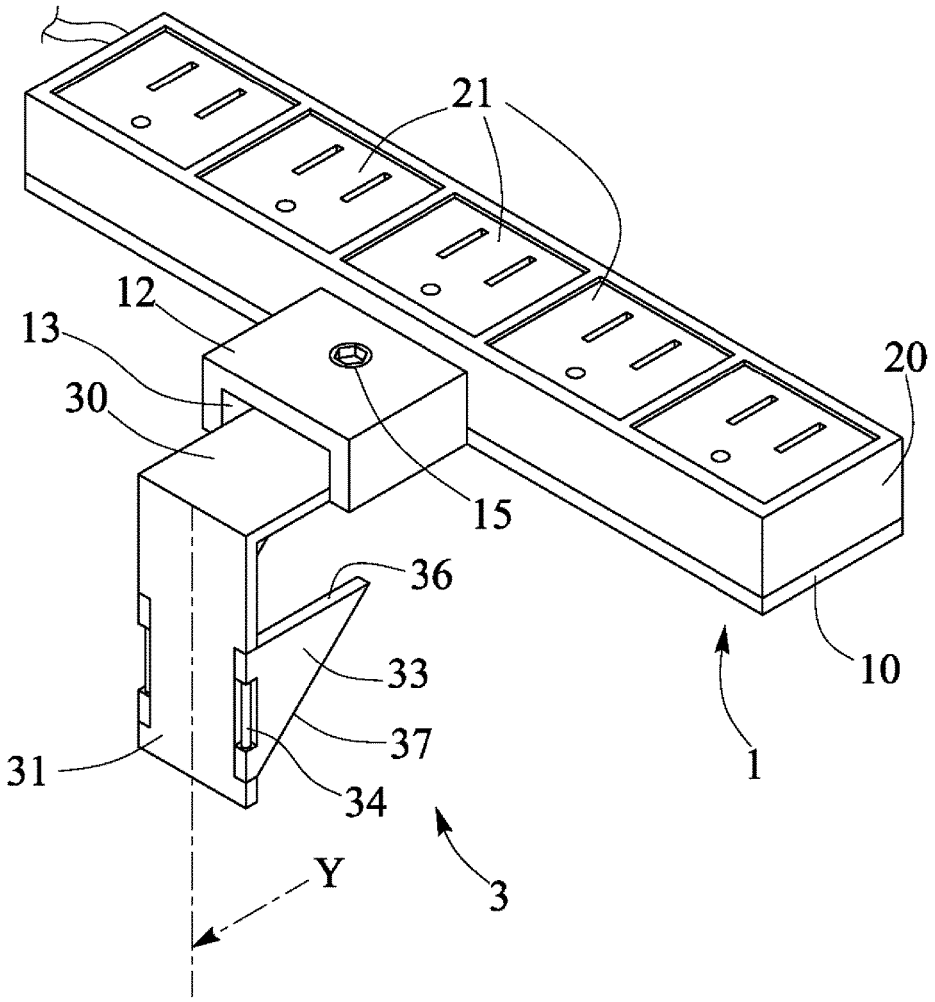
FIG. 2 is a perspective view of the power strip assembly.
Figure 3:
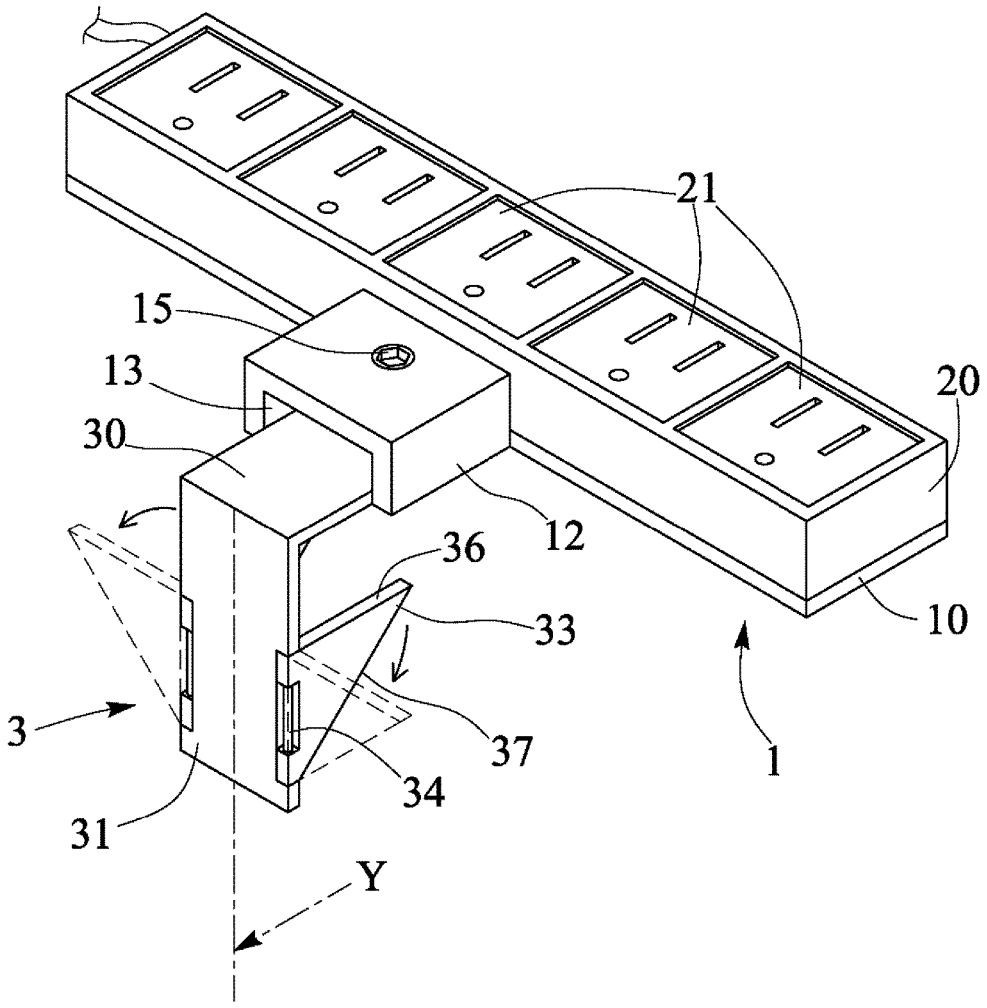
FIG. 3 is another perspective view similar to FIG. 2, illustrating the operation of the power strip assembly.

Referring to the drawings, and initially to FIGS. 1-3, a power strip assembly in accordance with the present invention comprises a carrier device 1 including a carrier member or panel 10 having one or more (such as four) pins or pegs 11 extended therefrom, such as extended upwardly therefrom (FIG. 1), the carrier panel 10 of the carrier device 1 is arranged to be engaged onto and supported on the upper surface 80 of the table plate 8 (FIGS. 4-5), the carrier device 1 includes a housing or bracket or carrier member 12 actuated thereto or extended outwardly therefrom and/or formed integral with the carrier panel 10, the carrier member 12 includes a chamber or compartment 13 formed therein and having a non-circular cross section and opened downwardly and rearwardly, and includes a through hole 14 formed therein (FIG. 1) and communicating with the compartment 13 of the carrier member 12 for slidably or pivotally or rotatably receiving or engaging with a bolt or screw or fastener 15.

A housing or receptacle 20 is arranged to be engaged onto and supported on the carrier panel 10 of the carrier device 1, one or more sockets or plug connecting members 21 are received or engaged in the receptacle 20 for engaging with plugs (not illustrated) or the like, the receptacle 20 may be solidly and stably attached or mounted or secured to the carrier panel 10 of the carrier device 1 with screws or bolts or catches or latches or fasteners or the like, and/or may be formed integral with the carrier panel 10 of the carrier device 1, for example, the receptacle 20 includes one or more (such as four) holes or cavities 22 formed therein (FIG. 1) for receiving or engaging with the pegs 11 of the carrier panel 10 of the carrier device 1 with such as a force-fitted engagement for allowing the receptacle 20 to be solidly and stably anchored or retained or positioned on the carrier panel 10 of the carrier device 1.

Figure 4:
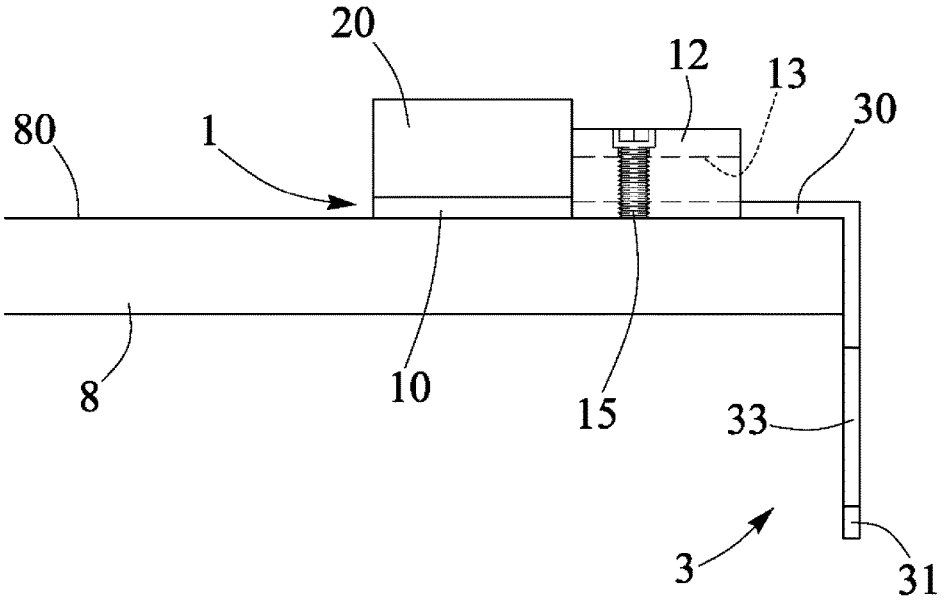
FIGS. 4, 5 are side plan schematic views illustrating the operation of the power strip assembly.
Figure 5:
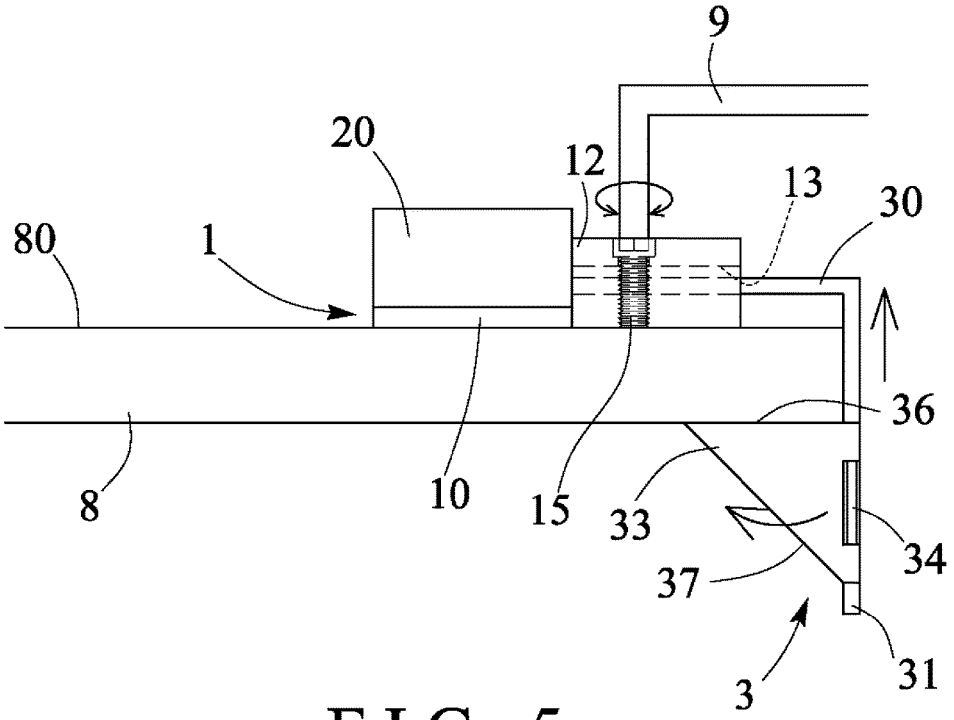

A clamping device 3 includes a base plate or sliding member or follower 30 slidably received or engaged in the compartment 13 of the carrier member 12 (FIGS. 2-5) and having a non-circular cross section or outer peripheral structure or configuration or contour similar to that of the compartment 13 of the carrier member 12 for being guided and limited to slide up and down along or relative to the compartment 13 of the carrier member 12 and for preventing the follower 30 from being pivoted or rotated or moved sidewise relative to the carrier member 12, the follower 30 includes a screw hole 32 formed therein (FIG. 1) and aligned with the through hole 14 of the carrier member 12 for threading or engaging with the fastener 15 and for allowing the follower 30 to be actuated or operated to slide or move up and down along or relative to the compartment 13 of the carrier member 12 when the fastener 15 is selectively rotated or driven by a screw driver or wrench or driver tool 9 (FIG. 5), and thus for guiding and moving the follower 30 to slide or move up and down relative to the upper surface 80 of the table plate 8 (FIGS. 4-5).

The follower 30 further includes an anchoring or hanger or coupling plate or extension 31 extended downwardly therefrom and perpendicular to the follower 30 and preferably or selectively disposed or located outside the compartment 13 of the carrier member 12 (FIGS. 2-5), and arranged for allowing the coupling extension 31 of the follower 30 to be easily and quickly engaged through a tiny space that is formed or provided beside an edge portion of the table plate 8 or between the edge portion of the table plate 8 (FIGS. 4-5) and a wall member (not illustrated) or the like, and to be easily and quickly attached and mounted to and engaged onto the table plate 8. The follower 30 further includes one or more (such as two) guiding or anchoring boards or elements 33 pivotally or rotatably attached or mounted or secured to the coupling extension 31 of the follower 30 with pivot axles 34 respectively and located below the follower 30.

For example, the pivot axles 34 are parallel to the longitudinal axis Y of the coupling extension 31 of the follower 30 for allowing the anchoring elements 33 to be pivoted or rotated relative to the coupling extension 31 (FIG. 3) between a first or working position where the anchoring elements 33 are in line with or parallel to the coupling extension 31 as shown in dotted lines in FIG. 3 and as shown in FIG. 4, and a second or folding position where the anchoring elements 33 are perpendicular to the coupling extension 31 (FIGS. 2, 5) and arranged and located below the table plate 8, and where the table plate 8 may be located or engaged between the follower 30 and the anchoring elements 33.

In operation, as shown in dotted lines in FIG. 3 and as shown in FIG. 4, the anchoring elements 33 may be pivoted or rotated relative to the coupling extension 31 to the first or working position where the anchoring elements 33 are in line with or parallel to the coupling extension 31 for allowing the anchoring elements 33 and the coupling extension 31 to be easily and quickly fed through the tiny space that is formed or provided beside or between the edge portion of the table plate 8 and the wall member (not illustrated) or the like. When or after the anchoring elements 33 have been moved over or beyond the table plate 8, the anchoring elements 33 may then be pivoted or rotated relative to the coupling extension 31 to the second or folding position where the anchoring elements 33 are perpendicular to the coupling extension 31 (FIGS. 2, 3, 5), and the fastener 15 may then be rotated or driven by the screw driver tool 9 in order to force the follower 30 to slide or move up relative to the upper surface 80 of the table plate 8 (FIG. 5) and thus to solidly and stably attach or mount or secure the follower 30 and the carrier member 12 to the table plate 8.

It is to be noted that the driver tool 9 for engaging with and for actuating or operating or rotating or driving the fastener 15 may be arranged and located above the table plate 8 while or when the driver tool 9 is rotated or driven or actuated or operated by the user, such that the power strip assembly in accordance with the present invention may be easily actuated or operated by the user. It is further to be noted that the follower 30 itself may also be forced to slide or move up and down relative to the upper surface 80 of the table plate 8 with the fastener 15, and the carrier member 12 may be formed integral with the follower 30 for supporting the object or apparatus or facility (not illustrated), such as keyboard, monitor, displayer or the like.

It is preferable that the anchoring elements 33 each include a tilted or inclined lower or bottom surface 36 which is tilted or inclined relative to the coupling extension 31 and the pivot axles 34, and arranged for allowing the anchoring elements 33 to be pivoted or rotated relative to the coupling extension 31 to the first or working position where the anchoring elements 33 are in line with or parallel to the coupling extension 31, with or by the table plate 8 when the anchoring elements 33 and the coupling extension 31 are engaged through the tiny space that is formed or provided beside or between the edge portion of the table plate 8 and the wall member (not illustrated) or the like, and it is preferable that the anchoring elements 33 each include a flat upper surface 37 which is perpendicular to the coupling extension 31 and parallel to the follower 30 and the carrier member 12 and the table plate 8 for allowing the follower 30 to be solidly and stably anchored or retained or secured to the table plate 8 with the anchoring elements 33 and the fastener 15.

Accordingly, the power strip assembly in accordance with the present invention may be easily actuated or operated by the user, and may be easily actuated to a table or support member by the user, and includes an anchoring board attachable to a carrier member for allowing the carrier member to be easily and quickly engaged through a tiny space beside an edge portion of a table plate and to be easily and quickly attached and mounted to the table plate.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A power strip assembly for attaching to a table plate, comprising:

a carrier device including a carrier panel, and including a carrier member extended from said carrier panel, a receptacle supported on said carrier panel, a plurality of plug connecting members engaged in said receptacle, a clamping device including a follower to be supported on the table plate, a coupling extension extended from said follower, and an anchoring element provided below said follower and pivotally attached to said coupling extension of said follower with a pivot axle for engaging with the table plate, said follower including a screw hole formed therein, said anchoring element being pivotable relative to said coupling extension between a first position where said anchoring element is parallel to said coupling extension, and a second position where said anchoring element is perpendicular to said coupling extension, and a fastener engaged through said carrier member and engaged with said screw hole of said follower for moving said follower up and down relative to the table plate when said fastener is rotated relative to said follower, for allowing said follower to be secured to the table plate with said fastener.

2. The power strip assembly as claimed in claim 1, wherein said anchoring element includes a tilted lower surface inclined relative to said coupling extension and said pivot axle.

3. The power strip assembly as claimed in claim 1, wherein said anchoring element includes a flat upper surface perpendicular to said coupling extension and parallel to said follower and the table plate.

4. The power strip assembly as claimed in claim 1, wherein said carrier member includes a compartment formed in said carrier member, said carrier member includes a through hole formed in said carrier member and communicating with said compartment of said carrier member and aligned with said screw hole of said follower for engaging with said fastener.

5. The power strip assembly as claimed in claim 4, wherein said compartment of said carrier member includes a non-circular cross section and opened downwardly, and said follower includes a non-circular cross section for being guided and limited to slide up and down relative to said compartment of said carrier member and for preventing said follower from being rotated relative to said carrier member.

6. A power strip assembly for attaching to a table plate, comprising:

a carrier device including a carrier panel, and including a carrier member extended from said carrier panel, a receptacle supported on said carrier panel, a plurality of plug connecting members engaged in said receptacle, a clamping device including a follower to be supported on the table plate, a coupling extension extended downwardly from said follower, and two anchoring elements provided below said follower and each pivotally attached to said coupling extension of said follower with a pivot axle for engaging with the table plate, said follower including a screw hole formed therein, said anchoring elements being pivotable relative to said coupling extension between a first position where said anchoring element is parallel to said coupling extension, and a second position where said anchoring element is perpendicular to said coupling extension, and a fastener engaged through said carrier member and engaged with said screw hole of said follower for moving said follower up and down relative to the table plate when said fastener is rotated relative to said follower, for allowing said follower to be secured to the table plate with said fastener.

7. The power strip assembly as claimed in claim 6, wherein said anchoring elements each include a tilted lower surface inclined relative to said coupling extension and said pivot axle.

8. The power strip assembly as claimed in claim 6, wherein said anchoring elements each include a flat upper surface perpendicular to said coupling extension and parallel to said follower and the table plate.

* * * * *